US006869387B2

(12) United States Patent
Post et al.

(10) Patent No.: US 6,869,387 B2
(45) Date of Patent: Mar. 22, 2005

(54) FORMER FOR FORMING A RECTANGULAR BAG TUBE

(75) Inventors: William E. Post, Canton, OH (US); Larry L. Lanham, Canton, OH (US)

(73) Assignee: Polymer Packaging, Inc., North Canton, OH (US)

( * ) Notice: Subject to any disclaimer, the term of this patent is extended or adjusted under 35 U.S.C. 154(b) by 20 days.

(21) Appl. No.: 10/246,055

(22) Filed: Sep. 18, 2002

(65) Prior Publication Data

US 2003/0054928 A1 Mar. 20, 2003

Related U.S. Application Data

(60) Provisional application No. 60/323,595, filed on Sep. 19, 2001.

(51) Int. Cl.[7] ..... B31B 1/44

(52) U.S. Cl. ..... 493/153; 493/155; 493/218

(58) Field of Search ..... 493/153, 155, 493/218, 219, 229, 232, 163, 175; 53/578, 563, 551, 554, 451

(56) References Cited

U.S. PATENT DOCUMENTS 201,832 A * 3/1878 Raymond ..... 493/232
1,989,111 A * 1/1935 Potdevin ..... 493/232
2,235,348 A 3/1941 Amberg
3,760,558 A * 9/1973 Kaminsky et al. ..... 53/567
3,807,118 A * 4/1974 Pike ..... 53/410
4,079,662 A * 3/1978 Puccetti et al. ..... 53/552
4,091,595 A * 5/1978 Pelster et al. ..... 53/417
4,355,494 A * 10/1982 Tilman ..... 53/416
4,452,596 A 6/1984 Clauss et al.
4,666,423 A * 5/1987 Herrington ..... 493/394
4,730,766 A 3/1988 Fear
4,915,680 A * 4/1990 Nestle et al. ..... 493/417
5,102,384 A 4/1992 Ross et al.
5,246,416 A * 9/1993 Demura et al. ..... 493/439
5,468,206 A 11/1995 Buchanan
5,549,538 A * 8/1996 Marsik ..... 493/218
5,685,132 A * 11/1997 Romijn et al. ..... 53/551
5,732,532 A * 3/1998 Fujisaki et al. ..... 53/451
5,857,954 A 1/1999 Achelpohl et al.
5,913,764 A 6/1999 Kolbe et al.
6,042,526 A 3/2000 Baumer
6,056,681 A 5/2000 Ross
6,132,351 A 10/2000 Lotto et al.

* cited by examiner

*Primary Examiner*—Samen H. Tawfik
(74) *Attorney, Agent, or Firm*—Zollinger & Burleson, Ltd.

(57) ABSTRACT

A former allows rectangular tubes of material to be quickly formed for creating bags having rectangular cross sections. The former provides a transition between a round former and a rectangular former so that the material used to form the bag is initially wrapped into a tube around a round former so that the material does not tear on the corners of the former. The round tube of material is then drawn down over the former of the invention to change the round tube to a rectangular tube that may be formed into the bag.

9 Claims, 3 Drawing Sheets

FORMER FOR FORMING A RECTANGULAR BAG TUBE

CROSS REFERENCE TO RELATED APPLICATIONS

The present application claims priority from U.S. provisional application Ser. No. 60/323,595 filed Sep. 19, 2001; the disclosures of which are incorporated herein by reference.

BACKGROUND OF THE INVENTION

1. Technical Field

The present invention generally relates to equipment used for forming bags and, more particularly, to equipment used to form and guide a tube of material before the material is formed into a bag. Specifically, the present invention relates to a former used to create square or rectangular tubes that are formed into bags.

2. Background Information

Various types of flexible packaging are formed with square or rectangular cross sections. These types of flexible packaging are commonly used in fast food retail establishments, grocery stores, and as lunch bags.

These bags are commonly formed by transforming a flat sheet of material into a tube that is folded into the bag. The material may be a polymer material, a metal material, or paper material. In order to form a bag with a square or rectangular cross section, the tube of material must have the same cross section. In prior art forming apparatus, the material used to form the bag would be drawn from a rolled supply of material and rolled over into a tube around a former that has the same cross section of the bag. In square and rectangular applications, the former would have the relatively sharp corners that are used to form the longitudinal corners of the bag.

A problem with this type of former is that the material being wrapped around and drawn over the former tears on the corners. The frequency of tearing increases as the drawing speed increases. The frequency of tearing also increases as the strength of the material decreases. As bag customers desire inexpensive bags, manufacturers are forced to use thinner materials run at higher speeds. This combination greatly increases the frequency of material tears. Each material tear requires the manufacturer to clear and reset the forming apparatus incurring significant downtime. In order to reduce these tears, the manufacturer must run the apparatus at a slow speed. The slow speed decreases the efficiency of the apparatus and bag manufacturers desire an apparatus that allows the speed of the apparatus to be increased while reducing the frequency of the tears.

BRIEF SUMMARY OF THE INVENTION

The invention provides a former that allows rectangular tubes of material to be quickly formed for creating bags having rectangular cross sections. The former provides a transition between a round former and a rectangular former so that the material used to form the bag is initially wrapped into a tube around a round former so that the material does not tear on the corners of the former. The round tube of material is then drawn down over the former of the invention to change the round tube to a rectangular tube that may be formed into the bag.

The invention also provides a method for manufacturing a bag wherein a section of material is initially wrapped around a round former to form a round tube of material. The method then includes the step of drawing the material over a transition former that has a round cross section that transitions into a rectangular cross section. This step of the method forms a tube of material having a rectangular cross section that may be formed into the final bag.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
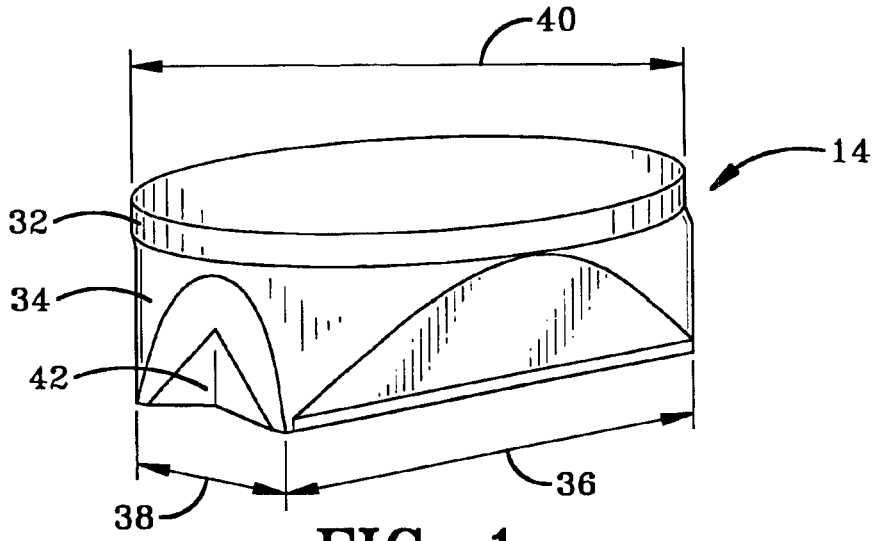
FIG. 1 is a perspective view of the transition former of the invention.
Figure 2:
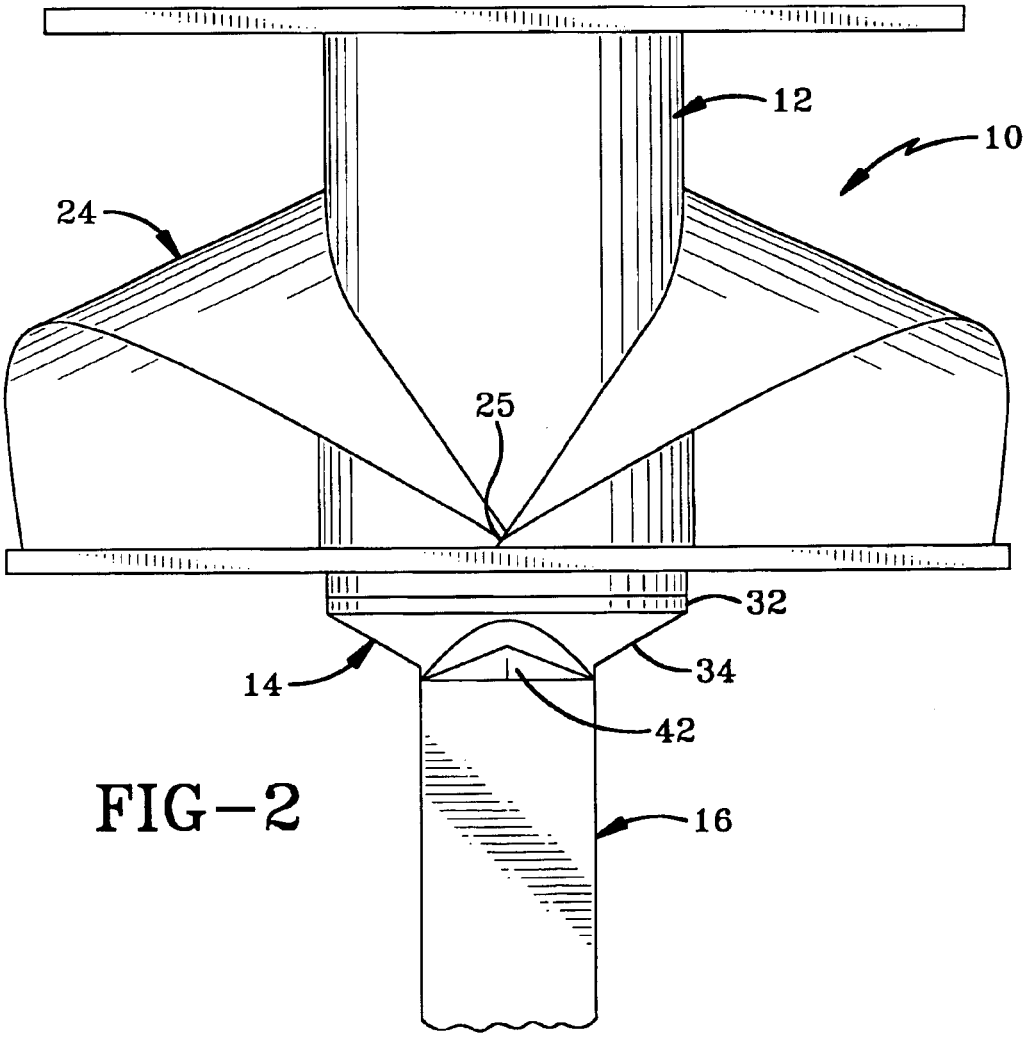
FIG. 2 is a front view of the bag forming apparatus showing the transition former disposed a round former and a rectangular former.
Figure 3:
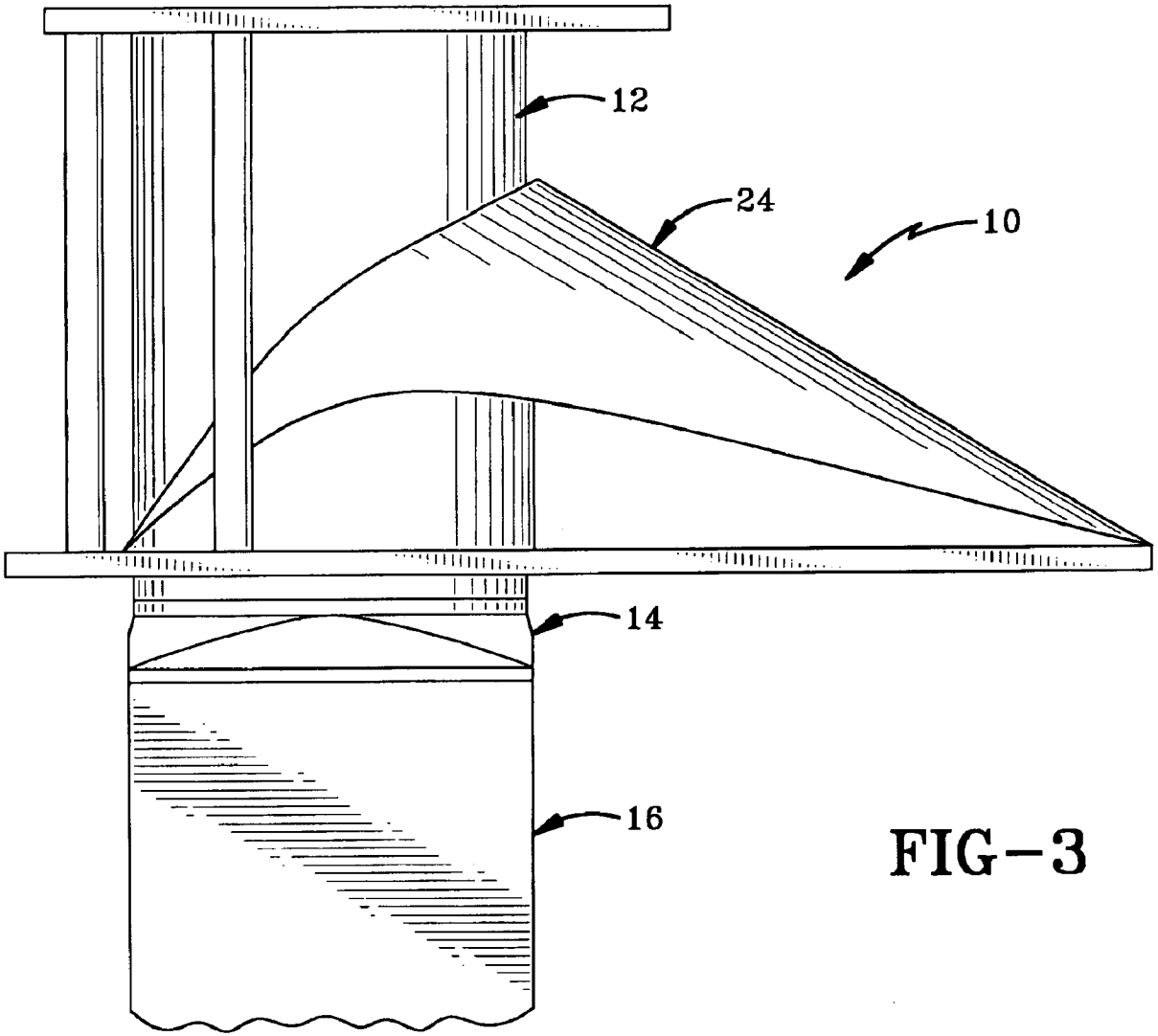
FIG. 3 is a side view of the apparatus of FIG. 2.
Figure 4:
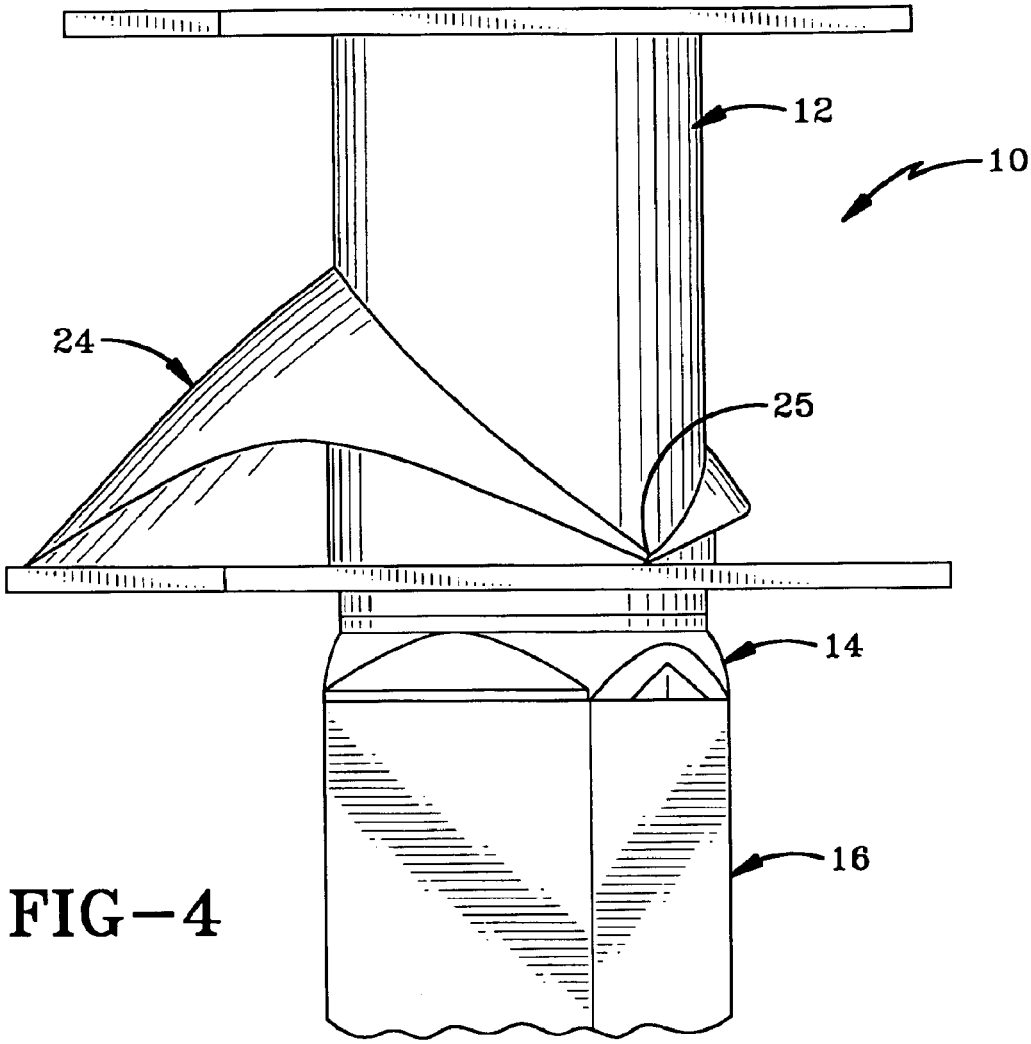
FIG. 4 is a side view looking at one of the corners of the apparatus.
Figure 5:
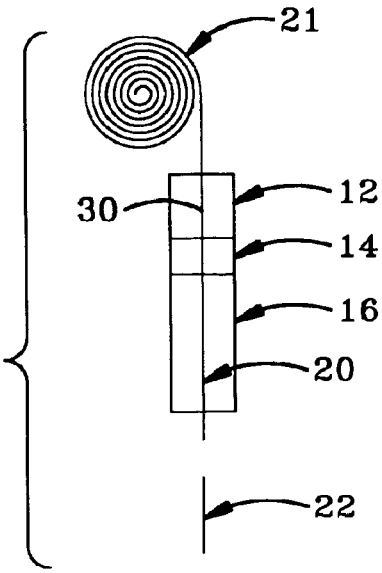
FIG. 5 is a schematic of the bag forming process using the former apparatus of the invention.

A first embodiment of the former apparatus according to the present invention is indicated generally by the numeral 10 in the accompanying drawings. Former apparatus 10 generally includes a round former 12, a transition former 14, and a rectangular former 16. Apparatus 10 is used to form a rectangular tube 20 of material from a supply 21 such as a rolled coil. Apparatus 10 may be used to form rectangular tube 20 with thin materials while reducing the tearing frequency. Apparatus 10 also significantly speeds up the tube forming process. Tube 20 may be used to form bags 22 having a rectangular cross section.

Apparatus 10 allows rectangular tube 20 to be formed more quickly than the prior art apparatus while preventing the material from tearing. The material does not tear as easily as with prior art apparatus because the material is first drawn over round former 12 that is free of sharp corners. The lack of corners on round former 12 significantly reduces the frequency of tearing when the material is wrapped around former 12 to form a round tube 30.

Round former 12 includes a collar 24 having overlapping ends 25 over which the material is drawn to form round tube round tube 30. Overlapping ends 25 allow the longitudinal seam of the bag to be created as the material is used to form the bag. The tube of material is then moved over transition former 14.

Transition former 14 is used to change round tube 30 into rectangular tube 20. The upper portion 32 of transition former 14 has a diameter 40 that is substantially equal to but slightly smaller than the inner diameter of round tube 30. The lower portion 34 of transition former 14 is in the shape of a rectangle having a width 36 and depth 38. In the embodiment of the invention depicted in the drawings, width 36 is 4% larger than diameter 40 and depth 38 is 36% of diameter 40. For example, if diameter 40 is 10 inches, width 36 is 10.4 inches with depth 38 is 3.6 inches. In other embodiments of the invention, the percentages may change without departing from the concepts of the invention.

Lower portion 34 defines a pair of opposed V-notches 42 that allow the short sides of tube 20 to be creased and folded inwardly as the tube moves over former 14.

The use of former 14 allows material to be formed into rectangular tube 20 significantly faster than the prior art tube-forming apparatus. Transition former 14 further prevents tearing.

The elements of apparatus 10 may be hollow to allow bags to be filled through apparatus 10. Hollow apparatus 10 may also accommodate other equipment, connections, or controls.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A former apparatus used to form a rectangular tube of material that is used to manufacture a rectangular bag; the former apparatus comprising:

a round former adapted to form a tube of the material having a round cross section;

a rectangular former adapted to support a tube of the material having a rectangular cross section; and a transition former disposed between the round former and the rectangular former; the transition former adapted to form a rectangular tube of material from the round tube of material as the round tube passes over the transition former; wherein the transition former includes an upper portion having a round cross section and a lower portion having a rectangular crosss section.

2. The apparatus of claim 1, wherein the upper portion has a diameter and the lower portion has a width and a depth; the width of the lower portion being larger than the diameter of the upper portion; the depth of the lower portion being smaller than the diameter of the upper portion.

3. The apparatus of claim 2, wherein the width of the lower portion is four percent larger than the diameter of the upper portion.

4. The apparatus of claim 3, wherein the depth of the lower portion is thirty-six percent smaller than the diameter of the upper portion.

5. The apparatus of claim 2, wherein the lower portion defines opposed notches.

6. The apparatus of claim 5, wherein the opposed notches are V-shaped.

7. The apparatus of claim 6, wherein the lower portion defines the notches along the depth of the former.

8. The apparatus of claim 1, further comprising a collar disposed about a portion of the round former.

9. The apparatus of claim 8, wherein the collar has overlapping ends.

* * * * *